US005772957A

United States Patent [19]

Thomson et al.

[11] Patent Number: 5,772,957

[45] Date of Patent: Jun. 30, 1998

[54] HIGH STRENGTH STEEL COMPOSITION HAVING ENHANCED LOW TEMPERATURE TOUGHNESS

[75] Inventors: Iain A. Thomson, Portland; Larry G. Ward, Milwaukie; James Peck, Clackamas; Dwayne E. Lewis, Oregon City, all of Oreg.

[73] Assignee: Blount, Inc., Montgomery, Ala.

[21] Appl. No.: 702,357

[22] Filed: Aug. 23, 1996

Related U.S. Application Data

[63] Continuation-in-part of Ser. No. 431,438, May 1, 1995, Pat. No. 5,651,938.

[51] Int. Cl.[6] ..... C22C 38/44; C21D 9/00

[52] U.S. Cl. ..... 420/108; 148/335; 148/663

[58] Field of Search ..... 148/335, 336, 148/663; 420/108, 119, 127; 30/381

[56] References Cited

U.S. PATENT DOCUMENTS

| | | |
|---|---|---|
| 3,655,366 | 4/1972 | DePaul . |
| 3,663,316 | 5/1972 | Kulmburg . |
| 3,854,363 | 12/1974 | Merkell et al. . |
| 3,907,614 | 9/1975 | Bramfitt et al. . |
| 4,062,705 | 12/1977 | Gondo et al. . |

FOREIGN PATENT DOCUMENTS

| | | |
|---|---|---|
| 2063940 | 1/1970 | Germany . |
| 61-174323A | 1/1985 | Japan . |
| 5-171288A | 12/1991 | Japan . |
| 6-316728 | 4/1993 | Japan . |
| 711153 | 1/1980 | U.S.S.R. . |
| 2 170 223 | 1/1985 | United Kingdom . |

OTHER PUBLICATIONS

Key To Steels, 10 Edition 1974, Germany.

"Alloying Elements in Steel," *American Society for Metals*, 2nd Ed., p. 244 (1961).

*Primary Examiner*—Deborah Yee

*Attorney, Agent, or Firm*—Klarquist Sparkman Campbell Leigh & Whinston, L.L.P.

[57] ABSTRACT

An iron composition and method for processing the composition that produces a steel alloy having enhanced low temperature toughness, without compromising other desirable mechanical properties, is described. The composition can be used to produce devices, such as saw chain, particularly useful for low temperature applications. In general, the steel composition comprises from about 0.2 weight percent to about 0.4 weight percent nickel, from about 0.2 to about 0.4 weight percent chromium, from about 0.5 weight percent to about 1.0 weight percent carbon, from about 0.3 to about 0.5 weight percent manganese, from about 0.1 to about 0.35 weight percent silicon, and from about 0.08 weight percent to about 0.20 weight percent molybdenum. After heat treating, the steel composition has an average fracture toughness of greater than about 42 ksi $in^{1/2}$, and an average modified Charpy energy-to-failure of greater than about 2 ft.lbs at temperatures greater than about −20° F. A method for making and heat treating the compositions also is described. Plural saw chain components may be made from the alloy and then assembled into saw chain.

23 Claims, 1 Drawing Sheet

HIGH STRENGTH STEEL COMPOSITION HAVING ENHANCED LOW TEMPERATURE TOUGHNESS

CROSS REFERENCE TO RELATED APPLICATIONS

This application is a continuation-in-part of U.S. application Ser. No. 08/431,438 (parent application), entitled "High Strength Steel Composition Having Enhanced Low Temperature Toughness," which was filed on May 1, 1995, now U.S. Pat. No. 5,651,938. The parent application is incorporated herein by reference.

FIELD OF THE INVENTION

This invention concerns steel compositions and products made therefrom.

BACKGROUND OF THE INVENTION

"Steel" is a general term that refers to iron alloys having over 50% iron and up to about 1.5% carbon, as well as additional elements. There are a number of known steel compositions. For instance, certain iron-chromium alloys having from about 12% to about 18% chromium and about 8% nickel are referred to as stainless steels. Other elements, such as molybdenum, manganese and silicon, also are routinely added to iron alloys to provide desired characteristics. Certain elements may be added to molten steel compositions to effect deoxidation, control grain size, and to improve mechanical, thermal and corrosion properties. Iron alloys of different chemical compositions have been developed to meet the requirements for particular applications.

Steel compositions also can be processed to have various microstructures, including pearlite, bainite and martensite microstructures, by varying the composition and heat processing steps. Martensitic materials generally have a relatively high strength, but are not very ductile. Pearlitic materials have the reverse characteristics, that is relatively low strength but high ductility. When bainitic and martensitic materials have equivalent hardnesses, the bainitic materials typically are less strong than the martensitic materials, but also are more ductile. Thus, the bainitic materials exhibit a good combination of both strength and ductility.

Bainite microstructures typically are formed in an isothermal transformation process. To produce materials having a bainite microstructure, a steel composition is rapidly cooled from a fairly high temperature of greater than about 1500° F. (the austenitizing temperature) to a temperature of about 475°–650° F. (the austempering temperature). The steel composition is austempered for a sufficient period of time to complete the transformation of the steel composition from an austenitic face-centered cubic microstructure to a bainitic body-centered cubic structure. The time and temperature required to produce different microstructures are interrelated.

Steel compositions have been used for years to make tools for working and forming metals, wood, plastics and other materials. These devices must withstand high specific loads, and often operate at elevated or rapidly changing temperatures. This creates problems, such as stress failure, when steels are in contact with abrasive types of work materials or subjected to shock or other adverse conditions. Ideally, tools operating at ambient conditions and under normal operating conditions should not suffer damage, unnecessary wear, or be susceptible to detrimental metallurgical changes.

Saw chain is one example of a device that is made from iron alloys. The iron alloys used to produce saw chain are chosen to balance several requirements, including, but not limited to, wear resistance, strength, fatigue resistance and toughness. These requirements have best been met for normal applications with an iron alloy that is substantially the same for all major manufacturers of saw chain. This alloy can be used for low-temperature applications, although the unique requirements for low-temperature applications indicate that a new alloy would be desirable.

Certain regions of the world routinely experience winter temperatures colder than 0° F. As a result, certain jobs require using steel tools which perform satisfactorily at temperatures at least as low as 0° F., and perhaps as low as about −50° F. Steel devices operating under these conditions have particular operating requirements. Previous attempts to form steel compositions having enhanced low temperature toughness have generally proved to be unsatisfactory.

There are patented approaches to improving the toughness of steel alloys, although, as currently understood, none were developed particularly for low-temperature applications. Merkell et al.'s U.S. Pat. No. 3,854,363 (Merkell), which is incorporated herein by reference, discloses a steel composition that is particularly designed to have good wear resistance. However, Merkell also states that:

> The remarkably good toughness of the chain saw unit according to the invention, compared to corresponding quality of conventionally made units, consisting of saw chains and guide plates, has been produced by carefully adjusted carbon content of the steel alloy in combination with the alloying elements Si, Cr and Mo and/or W.

Merkell, column 2, lines 28–34. Emphasis added.

Merkell further states that:

> By making the links, for instance the cutter links, of the normally austempered steel according to the invention, i.e., the toughness is increased most essentially, not least at the cutting edge. As examples of preferably used steel compositions, identified in percentages by weight, may here be mentioned:
>
> 0.6–0.7 percent carbon, 1.0–1.4 percent silicon, 0.30–0.45 percent manganese, 0.4–0.6 percent chromium, 0.2–0.4 percent molybdenum, 0.1–0.2 percent vanadium, and the remainder iron with a normal small amount of impurities.

Merkell, at column 3, lines 26–36.

Kulmburg et al.'s U.S. Pat. No. 3,663,316 (Kulmburg) concerns a steel composition useful for forming saw chain. The alloy taught by Kulmburg has 0.6–0.9% carbon, 0.5–1.0% silicon, 0.4–1.0% manganese, 0.4–1.0% chromium, 0.2–0.8% molybdenum, 0.3–1.0% nickel, up to 0.3% titanium and/or vanadium, with the remainder being iron and impurities. Like Merkell, Kulmburg teaches using silicon as an alloying element, since the amount of silicon taught by Kulmburg can be as high as about 1.0 weight percent. Nonalloying amounts of silicon, also referred to herein as process modifying amounts of silicon, generally are less than 0.4 weight percent, and more typically are less than about 0.35 weight percent. Moreover, there is no discussion in Kulmburg of an alloy particularly useful for low-temperature applications. Instead, Kulmburg appears to teach increasing toughness by processing conventional alloys to have bainitic microstructures.

In summary, the prior art teaches that toughness can be enhanced by: (1) decreasing the carbon content of the alloy; (2) increasing the nickel content of the alloy [see, for instance, *Alloying Elements in Steel*, 2nd Ed., page 244, *American Society for Metals* (1961)]; or (3) increasing the silicon concentration in the alloy (Merkell). Kulmburg also teaches that the silicon content should be relatively high, but there is no discussion in Kulmburg concerning what effect varying the nickel, chromium and silicon weight percents has on the physical characteristics of the alloy.

The prior approaches to increasing toughness, particularly low-temperature toughness, are unsatisfactory. Reducing the carbon content reduces both the strength and the wear resistance. Increasing either the nickel content or the silicon content significantly increases the cost of the alloy. Moreover, increasing the silicon content makes the alloy hard to process because such alloys tend to crack, particularly during hot rolling or continuous casting procedures.

SUMMARY OF THE INVENTION

The present invention provides an iron composition and method for processing the composition that produces a steel alloy having enhanced low temperature toughness, while maintaining other desirable mechanical properties. The composition following heat treatment has a Rockwell "C" Hardness of at least about 49, and generally about 52–55. The composition has been used to produce devices for low temperature applications. For example, and without limitation, an embodiment of the present invention is particularly useful for making saw chain for use at temperatures below 0° F. Contrary to the teachings in the art, reducing the nickel content, as opposed to increasing the nickel content, increases the toughness of the steel composition when austempered.

An embodiment of the present invention is directed to a steel composition, which generally has a bainite microstructure after being heat treated. In general, the steel composition comprises: from about 0.2 weight percent to about 0.4 weight percent nickel; from about 0.2 to less than about 0.4 weight percent chromium; from about 0.5 weight percent to less than about 1.0 weight percent carbon; from about 0.3 to about 0.5 weight percent manganese; from about 0.08 weight percent to about 0.20 weight percent molybdenum; process-modifying amounts of silicon, such as from about 0.1 to about 0.35 weight percent silicon, and typically from about 0.2 weight percent to about 0.35 weight percent silicon; from about 0 to about 0.025 weight percent sulfur and phosphorous; with the remainder being iron. Working embodiments of the alloy have included from about 0.2 to about 0.45 weight percent nickel and from about 0.2 to less than about 0.3 weight percent chromium, with good results being achieved by alloys having from about 0.2 to about 0.3 weight percent nickel and from about 0.2 to about 0.3 weight percent chromium, with especially good results being achieved by alloys having about 0.25 weight percent nickel and about 0.25 weight percent chromium. It also is possible to substitute niobium for chromium in this composition.

The steel composition has an average fracture toughness after austempering of greater than about 42 ksi $in^{1/2}$, and an average energy-to-failure after austempering of greater than about 2 ft.lbs at temperatures greater than about −20° F. For low temperature applications, it is desirable for the composition to have both good toughness and tensile strength. Thus, it is preferred that the alloys have a toughness to strength ratio (fracture toughness to the tensile strength) after austempering of greater than about 0.15 ksi $in^{1/2}$/ksi, preferably greater than about 0.16 ksi $in^{1/2}$/ksi. Moreover, for low temperature applications it is preferred that the alloys have good impact toughness to maximum load values, which are determined by the ratio of the propagation energy to the maximum load. Thus, it is preferred that the impact toughness to maximum load value generally be greater than about 0.0018 ft.lbs/lbs at room temperature, and preferably at least about 0.002 ft.lbs/lbs. At −40° F., the impact toughness to maximum load value generally is greater than about 0.0014 ft.lbs/lbs, and preferably is at least about 0.0016 ft.lbs/lbs.

The steel compositions of the present invention also may include minor fractions of impurities. This means that the iron alloy typically consists essentially of less than about 1.0 weight percent carbon, less than about 0.4 weight percent nickel, less than about 0.4 weight percent chromium, from about 0.3 to about 0.5 weight percent manganese, from about 0.08 to 0.20 weight percent molybdenum, from about 0.1 to about 0.35 weight percent silicon, the remainder being iron and impurities.

The steel compositions of the present invention are most useful for low temperature applications. A method is therefore described for making steel compositions and devices made therefrom that are particularly useful for low temperature applications. The method comprises first forming an iron alloy as described herein. Devices and/or parts thereof are then formed from the composition. The composition can be used for forming tools of many configurations, and for various applications. An embodiment of the present invention is particularly useful for the manufacture of saw chain components, such as chain links, and saw chain that is assembled from plural such components. Thus, the invention can be used to produce a heat-treated saw chain link. The link typically has a bainite microstructure after being heat treated. The composition or parts made therefrom are heat treated by heating to a temperature of greater than about 1500° F. and less than about 1750° F., referred to herein as austenitizing. The austenitizing temperature preferably is about 1650° F. As used herein, "heat treating" typically refers to first heating the alloy above the minimum austenitizing temperature, austempering, and then finally cooling to ambient temperature.

The composition or devices made therefrom are maintained at the austenitizing temperature for a period of at least about five minutes, and more preferably for about 12 minutes. The composition or devices made therefrom are then quenched by immersing the heated alloy into a bath, such as a fluidized sand bed or a molten salt, at a temperature of from about 475° F. to about 650° F., and preferably from about 500° F. to about 600° F., for a period of time of at least about ten minutes, and preferably for about an hour. Processing times are related to the processing temperatures. At lower processing temperatures longer processing times are required. Devices made from the steel composition and processed in this manner typically have an average fracture toughness of greater than about 42 ksi $in^{1/2}$, and an average energy-to-failure of greater than about 2 ft.lbs at temperatures greater than about −20° F.

The method for forming saw chain comprises assembling plural saw chain components into a saw chain. The plural saw chain components are produced, typically using a die punch, from the iron alloys described above. The method comprises first forming plural saw chain components from the alloy, heat treating the components and then assembling them into saw chain.

An object of the present invention is to provide a novel steel composition.

Another object of the present invention is to provide a steel composition that has enhanced low temperature toughness without compromising other desirable mechanical properties.

Another object of the present invention is to provide a steel composition wherein the low temperature toughness is increased relative to known steel compositions by reducing, rather than increasing, the nickel content without compromising other desirable mechanical properties.

Another object of the invention is to provide saw chain components, and saw chain assembled from plural such components, that can be produced cost effectively to have good toughness for low temperature applications without compromising other desirable mechanical properties.

An advantage of the present invention is that the steel composition has good low temperature toughness and reduced nickel content, which decreases the cost of the composition without compromising other desirable mechanical properties.

DETAILED DESCRIPTION OF THE INVENTION

Figure 1:
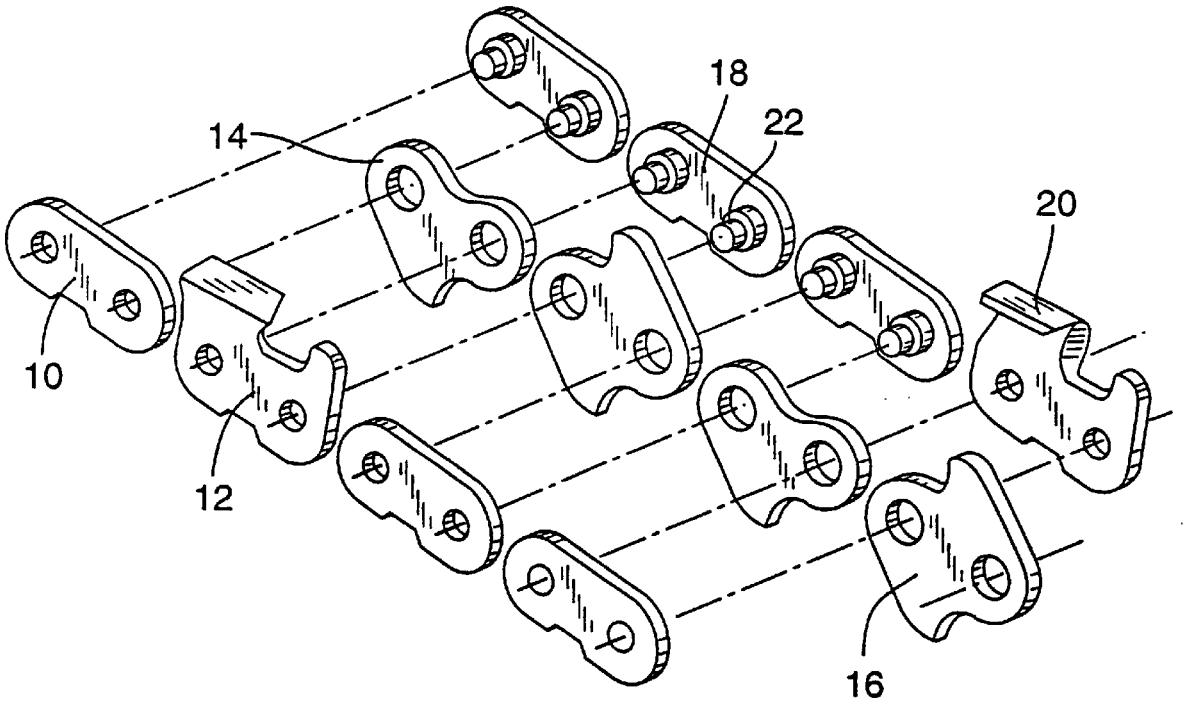
FIG. 1 is a disassembled schematic view of one design for chain components that are useful for assembling saw chain.

The steel compositions of the present invention are discussed in more detail below in Section I. Section II discusses how to make saw chain, which is just one example of a device that can be produced from the composition described herein.

I. COMPOSITION

In general, the present composition comprises an iron alloy that includes carbon, manganese, chromium, nickel and molybdenum. The balance of the composition is iron, possibly other processing additives, and normal small amounts of impurities.

The composition includes medium carbon concentrations, such as greater than about 0.5 weight percent and less than about 1.0 weight percent. The carbon content typically ranges from about 0.5 weight percent to about 0.8 percent, more typically from about 0.6 to about 0.7 weight percent.

With respect to nickel, and contrary to the teachings of the prior art, nickel amounts of less than about 0.4 percent produce steel compositions having enhanced low-temperature toughness. The nickel content typically ranges from about 0.2 to about 0.4 weight percent, and more typically from about 0.2 to about 0.35 weight percent, with about 0.25 weight percent being a currently preferred amount of nickel.

With respect to chromium, working embodiments of the alloy generally include from about 0.2 to about 0.4 weight percent, and more typically from about 0.2 to less than 0.3 weight percent chromium. Best results currently appear to be achieved by alloys having about 0.25 weight percent chromium.

Niobium can be substituted for chromium. This substitution seems reasonable as previous alloys, particularly developed for saw chain, have successfully been made by substituting niobium for chromium. Thus, the composition may comprise niobium in the particular weight percents stated above for chromium.

With respect to manganese, the weight percent typically varies from about 0.3 to about 0.5 weight and more typically from about 0.35 to about 0.45 weight percent.

With respect to molybdenum, the weight percent typically varies from about 0.08 to 0.20, and more typically from about 0.10 to about 0.13 weight percent.

Process modifying amounts of silicon typically are used to form the alloys. "Process modifying amounts" means less than about 0.35 weight percent, generally from about 0.1 to about 0.35 weight percent silicon, and more typically from about 0.2 to about 0.35 weight percent.

Certain impurities also typically are included in the present steel compositions, such as sulphur and phosphorous. These impurities preferably are completely eliminated, but in practice generally are present in weight percents of from about 0 to about 0.025 weight percent. It is difficult, if not impossible, to control the commercial production of steel compositions so that such compositions do not include impurities. The present invention therefore is sufficiently broad so as to cover compositions having small amounts of impurities.

The composition of the present invention is formed by combining the elements, or sources of such elements, listed above in the particular weight percents stated. Once these metals are combined in the proper weight percents, the composition is hot rolled and cold finished. Desired components are first formed from the composition and then heat treated as described below.

II. HEAT TREATING

The compositions are heat treated to provide the desired characteristics. The cold-rolled composition is first heated to a temperature that ranges from about 1500° F. to about 1750° F., and more typically from about 1600° F. to about 1675° F., with a currently preferred temperature being about 1650° F. The heating rate generally is unimportant for achieving the desired low temperature characteristics. The composition is heated to the desired temperature, such as about 1650° F., and held at that temperature for a period of time that typically is greater than about 5 minutes, and more typically varies from about five minutes to about twelve minutes. It appears that the best results are obtained when the composition is held at the processing temperature for at least five minutes. There likely is a reasonable maximum time, such as about six hours, beyond which heat processing may have a deleterious affect on the characteristics of the composition.

The composition is austempered. Certain terms used herein, including austempering, are terms known in the art. For instance, *Machineries Handbook*, Revised 21st Ed. (1979), provides a discussion of steel compositions, heat treatments, and standard industry terms. *Machineries Handbook* is incorporated herein by reference. *Machineries Handbook* defines austempering as "a heat treatment process consisting in quenching an iron-base alloy from a temperature above the transformation range in a medium having a suitable high rate of heat abstraction, and maintaining the alloy, until transformation is complete, at a temperature which is below that of pearlite formation and above that of martensite formation." Thus, after the iron alloys of the present invention are austenitized, they are then austempered by immersing the composition in a bath, such as, but not limited to, a fluidized bed of sand or a molten salt, such as a nitrate-nitrite salt. More specifically, the composition is first austenitized at about 1650° F., held at the austenitizing temperature for at least about 5 minutes, and then austempered by immersion in a molten salt which is held at a temperature of from about 475° F. to about 650° F., more typically from about 500° F. to about 600° F., for at least about 10 minutes. Steel compositions having the particular weight percents and processed as stated herein typically have a bainite microstructure.

III. PROPERTIES OF THE COMPOSITIONS

The steel compositions of the present invention have been tested to determine whether such compositions exhibit the characteristics required for low temperature applications. These tests included, but were not limited to, fracture toughness, Charpy impact tests and tensile tests.

Table 1 provides information concerning the weight percents of nickel and chromium that were used to form certain alloys according to the present invention. As indicated in Table 1, six alloys were tested. Alloys 2 through 4 were used to evaluate the characteristics of alloys wherein the chromium weight percent was maintained at about 0.25 percent, while the nickel content varied from about 0.25 weight percent to about 0.65 weight percent. Alloys 5 and 6 had about 0.45 weight percent chromium, and about 0.25 and 0.45 weight percent nickel, respectively. Alloy 7, which was used as a control, is a commercially available and successful steel composition used for forming saw chain. Alloy 7 has the following composition: from about 0.61 to about 0.72 weight percent carbon; from about 0.3 to about 0.5 percent manganese; from about 0.2 to about 0.35 weight percent silicon; from about 0.6 to about 0.9 percent nickel; from about 0.4 to about 0.6 weight percent chromium; from about 0.08 to about 0.15 weight percent molybdenum; and about 0.025 weight percent sulfur and phosphorous.

TABLE 1

| Alloy | % Nickel | % Chromium |
|---|---|---|
| 2 | 0.25 | 0.25 |
| 3 | 0.45 | 0.25 |
| 4 | 0.65 | 0.25 |
| 5 | 0.25 | 0.45 |
| 6 | 0.45 | 0.45 |
| 7 | 0.65 | 0.45 |

Based on the prior art, such as *Alloying Elements in Steel*, supra, it would be reasonable to believe that increasing the nickel content would enhance low temperature toughness of the composition. Thus, the prior art would predict that alloys 4, 6 and 7 would perform best.

Table 2 lists the results obtained from fracture toughness tests in ksi $in^{1/2}$ for each of the seven alloys. Fracture toughness is defined as the resistance to the propagation of an existing crack in a material. The fracture toughness tests were performed at Oregon Graduate Institute. Each of the alloys was tested at least fourteen times. Alloy 2 had both the lowest nickel and chromium content (0.25 weight percent); however, contrary to the teachings in the prior art, alloy 2 exhibited the highest mean fracture toughness of all the alloys tested. Alloys 4, 6 and 7 had much lower mean scores on the fracture toughness test. This is particularly surprising relative to the fracture toughness exhibited by the commercially available and successful alloy number 7, which had a mean fracture toughness of about 41.56.

Based on the fracture toughness tests, the composition having a nickel content of about 0.25 weight percent is a currently preferred composition. This does not mean that each of the other alloys are undesirable or inoperative. Alloys 2 and 3 had mean fracture toughness values which are higher than the mean fracture toughness value for standard alloy No. 7. Furthermore, the values reported for alloys 5 and 6 are within about 2.2 percent and 0.86 percent of the value reported for alloy 7, respectively. This indicates that the cost for producing an acceptable alloy can be decreased, because the nickel content is decreased, without compromising the quality of the alloy.

TABLE 2

| Ref | n | Mean | Std Dev | Low | High | Range |
|---|---|---|---|---|---|---|
| 2 | 15 | 48.93 | 3.88 | 42.00 | 56.00 | 14.00 |
| 3 | 15 | 47.20 | 3.14 | 42.00 | 51.00 | 9.00 |
| 4 | 16 | 43.94 | 2.77 | 40.00 | 49.00 | 9.00 |
| 5 | 14 | 40.64 | 3.25 | 36.00 | 48.00 | 12.00 |
| 6 | 15 | 41.20 | 2.18 | 38.00 | 46.00 | 8.00 |
| 7 | 16 | 41.56 | 3.79 | 36.00 | 49.00 | 13.00 |

The energy-to-failure for each of the alloys also was tested, and the results are listed in Table 3 in ft.lbs. As used herein, energy-to-failure refers to the energy required to cause a workpiece made from the alloy to fail, i.e, break. A modified Charpy impact test was conducted on the workpiece, wherein the modification concerned using a thinner workpiece having a thickness of about 0.063 inch. The energy-to-failure test was conducted at various temperatures, including room temperature, −20° F. and −40° F.

Again, as with the fracture toughness tests, the alloy having 0.25 percent nickel had the highest energy to failure at each of the temperatures tested. Moreover, the superiority of alloy number 2 is greater as the temperature is reduced. For instance, at room temperature alloy 2 had an energy to failure of about 2.1172 ft.lbs and alloy 7 had an energy to failure of about 1.7471 ft.lbs. Relative to the energy-to-failure values for alloy number 7, this reflects a percent difference of about 21.2%. At −20° F., the percent difference between alloy number 2 and alloy number 7 was about 113%, and about 89.9% for the results at −40° F. Thus, by decreasing the nickel content it has been found that the toughness of the alloys is increased, particularly at low temperatures, relative to commercially available and successful alloys.

Based on the energy-to-failure tests, the composition having a nickel content of about 0.25 weight percent currently is a preferred composition. This does not mean that the compositions reported for alloys 3 to 6 are undesirable or inoperative. Alloys 3 and 4 had a mean energy-to-failure which was higher than the mean energy-to-failure for standard alloy No. 7. Thus, by holding the chromium level at 0.25 weight percent, and decreasing the nickel content, a composition can be formed having good energy-to-failure at room temperature. Although alloy number 2 had the highest mean energy-to-failure at −20° F., alloys Nos. 3 and 4 also had acceptable energy-to-failure values at this temperature. At −20° F., alloys 5 and 6 did not have acceptable energy-to-failure values because the values were less than that for standard alloy No. 7. The data provided at −40° F. also indicates that alloy Nos. 2, 3 and 4 had higher energy-to-failure values than exhibited by the standard alloy No. 7.

TABLE 3

| Ref | n | Mean | Std Dev | Low | High | Range | |
|---|---|---|---|---|---|---|---|
| 2 | 11 | 2.1172 | 0.2339 | 1.8711 | 2.5319 | 0.6608 | Room |
| 3 | 11 | 1.7629 | 0.1759 | 1.4938 | 1.9983 | 0.5045 | Temp |
| 4 | 11 | 1.8979 | 0.3084 | 1.4148 | 2.3912 | 0.9764 | |
| 5 | 11 | 1.6895 | 0.4423 | 0.7410 | 2.1708 | 1.4298 | |
| 6 | 11 | 1.3142 | 0.5218 | 0.7098 | 2.3123 | 1.6025 | |
| 7 | 11 | 1.7471 | 0.3687 | 1.3138 | 2.3324 | 1.0186 | |
| 2 | 7 | 2.1068 | 0.4352 | 1.3312 | 2.5997 | 1.2685 | −20° F. |
| 3 | 7 | 1.8985 | 0.5943 | 0.8298 | 2.5375 | 1.7077 | |
| 4 | 7 | 1.6803 | 0.3746 | 1.2391 | 2.1821 | 0.9430 | |

TABLE 3-continued

| Ref | n | Mean | Std Dev | Low | High | Range | |
|---|---|---|---|---|---|---|---|
| 5 | 7 | 0.6886 | 0.1884 | 0.4633 | 0.8994 | 0.4361 | |
| 6 | 7 | 0.8328 | 0.1239 | 0.6980 | 0.9967 | 0.2987 | |
| 7 | 7 | 0.9868 | 0.3065 | 0.7112 | 0.5562 | 0.8450 | |
| 2 | 7 | 1.5234 | 0.6902 | 0.7394 | 2.6081 | 1.8687 | −40° F. |
| 3 | 7 | 1.4020 | 0.5780 | 0.4883 | 2.3022 | 1.8139 | |
| 4 | 7 | 1.1923 | 0.5854 | 0.4679 | 2.1128 | 1.6449 | |
| 5 | 7 | 0.6816 | 0.1492 | 0.5120 | 0.9315 | 0.4195 | |
| 6 | 6 \ | 0.6853 | 0.1897 | 0.4190 | 0.9123 | 0.4933 | |
| 7 | 7 | 0.8021 | 0.4334 | 0.3837 | 1.6100 | 1.2263 | |

Table 4 lists tensile strength values for each of the alloys in thousands of pounds per square inch (ksi). There are no statistically significant differences between the means reported in Table 4 for any of the alloys. The point of Table 4 is to demonstrate that the fracture toughness can be increased by decreasing the nickel and chromium content, while maintaining an acceptable tensile value. This again illustrates that acceptable alloys can be produced at a significant cost savings by decreasing both the chromium and nickel content.

TABLE 4

| Ref | n | Mean | Std Dev | Low | High | Range |
|---|---|---|---|---|---|---|
| 2 | 10 | 287.21 | 6.28 | 280.30 | 295.00 | 14.70 |
| 3 | 10 | 281.41 | 7.17 | 275.00 | 292.90 | 17.90 |
| 4 | 10 | 280.26 | 6.23 | 274.20 | 290.00 | 15.80 |
| 5 | 10 | 285.16 | 7.49 | 272.60 | 294.00 | 21.40 |
| 6 | 9 | 282.39 | 6.29 | 276.80 | 293.70 | 16.90 |
| 7 | 10 | 280.96 | 5.79 | 274.00 | 289.70 | 15.70 |

Table 5 lists the maximum load-to-failure for workpieces tested using a modified Charpy impact test. The modification of the standard Charpy impact test concerned the thickness of the tested workpiece. For the results listed in Table 5, the workpiece tested had a thickness of about 0.063 inch. Table 5 shows that alloy 2 sustained the highest average maximum load at room temperature, at −20° F. and at −40° F. Alloys 3, 4 and 5 also had acceptable maximum loads as compared to the standard alloy 7. Perhaps of more importance are the maximum load values at −20° F. and at −40° F. At these temperatures alloys having decreased nickel content relative to alloy 7, such as alloys 2 and 3, can sustain increased maximum loads.

TABLE 5

| Ref | n | Mean | Std Dev | Low | High | Range | |
|---|---|---|---|---|---|---|---|
| 2 | 11 | 1005.4 | 26.73 | 966.68 | 1049.2 | 82.47 | Room |
| 3 | 11 | 994.6 | 37.71 | 944.18 | 1052.7 | 108.52 | Temp |
| 4 | 11 | 991.2 | 57.79 | 918.11 | 1112.9 | 194.83 | |
| 5 | 11 | 930.7 | 80.14 | 736.69 | 1003.7 | 266.98 | |
| 6 | 11 | 869.6 | 115.2 | 705.65 | 1024.0 | 318.38 | |
| 7 | 11 | 957.8 | 63.1 | 878.04 | 1049.6 | 171.58 | |
| 2 | 7 | 1039.6 | 59.96 | 916.23 | 1102.4 | 186.14 | −20° F. |
| 3 | 7 | 1017.8 | 132.86 | 755.74 | 1191.9 | 436.13 | |
| 4 | 7 | 980.1 | 81.75 | 874.49 | 1103.2 | 228.73 | |
| 5 | 7 | 661.4 | 71.98 | 565.95 | 740.5 | 174.50 | |
| 6 | 7 | 746.7 | 28.20 | 711.56 | 788.7 | 77.14 | |
| 7 | 7 | 806.5 | 116.63 | 695.81 | 1027.8 | 331.97 | |
| 2 | 7 | 925.52 | 165.38 | 720.74 | 1131.5 | 410.74 | −40° F. |
| 3 | 7 | 906.96 | 172.02 | 587.06 | 1103.7 | 516.59 | |
| 4 | 7 | 835.67 | 188.92 | 575.67 | 1083.8 | 508.12 | |
| 5 | 7 | 691.01 | 72.95 | 599.46 | 778.7 | 179.25 | |

TABLE 5-continued

| Ref | n | Mean | Std Dev | Low | High | Range |
|---|---|---|---|---|---|---|
| 6 | 6 | 644.85 | 113.32 | 484.75 | 764.3 | 279.56 |
| 7 | 7 | 699.49 | 184.08 | 455.44 | 985.9 | 530.47 |

Table 6 lists the propagation energy values for alloys of the present invention at room temperature, −20° F. and −40° F. Table 6 shows that at room temperature the mean propagation energy for alloy 2 was higher than for standard alloy number 7. The standard alloy also had significantly lower propagation energy values than alloys 2–4. The mean propagation energy value at −20° F. for alloy number 2 is about 42% higher than the propagation energy value for alloy number 7. Alloys 3 and 4 also are significantly higher than the propagation energy value for alloy number 7. The same trend is observed in the propagation energy values listed at −40° F.

TABLE 6

| Ref | n | Mean | Std Dev | Low | High | Range | |
|---|---|---|---|---|---|---|---|
| 2 | 11 | 0.5639 | 0.168 | 0.2974 | 0.8438 | 0.5464 | Room |
| 3 | 11 | 0.3914 | 0.099 | 0.2606 | 0.5586 | 0.2980 | Temp |
| 4 | 11 | 0.4418 | 0.172 | 0.2121 | 0.7822 | 0.5701 | |
| 5 | 11 | 0.3994 | 0.186 | 0.1934 | 0.6956 | 0.5022 | |
| 6 | 11 | 0.3126 | 0.212 | 0.1799 | 0.8813 | 0.7014 | |
| 7 | 11 | 0.4036 | 0.182 | 0.2384 | 0.7349 | 0.4965 | |
| 2 | 7 | 0.3221 | 0.0836 | 0.2278 | 0.4961 | 0.2683 | −20° F. |
| 3 | 7 | 0.3150 | 0.0585 | 0.2329 | 0.3759 | 0.1430 | |
| 4 | 7 | 0.4012 | 0.2083 | 0.2530 | 0.7352 | 0.4822 | |
| 5 | 7 | 0.1959 | 0.0420 | 0.1447 | 0.2554 | 0.1107 | |
| 6 | 7 | 0.2435 | 0.0766 | 0.1720 | 0.3738 | 0.2018 | |
| 7 | 7 | 0.2262 | 0.0353 | 0.1888 | 0.2885 | 0.0997 | |
| 2 | 7 | 0.3441 | 0.1589 | 0.1908 | 0.5441 | 0.3533 | −40° F. |
| 3 | 7 | 0.2566 | 0.0803 | 0.1569 | 0.3983 | 0.2414 | |
| 4 | 7 | 0.2757 | 0.1465 | 0.1605 | 0.5869 | 0.4264 | |
| 5 | 7 | 0.2005 | 0.0594 | 0.1483 | 0.3222 | 0.1739 | |
| 6 | 6 | 0.2305 | 0.1365 | 0.1346 | 0.4976 | 0.3630 | |
| 7 | 7 | 0.1876 | 0.0509 | 0.1066 | 0.2493 | 0.1427 | |

The toughness-to-strength properties of the alloys according to the present invention can be gauged by reference to the ratio of the fracture toughness-to-tensile strength in ksi $in^{1/2}$/ksi. The ratio of the fracture toughness-to-tensile strength for alloys according to the present invention generally is greater than about 0.15, preferably greater than about 0.16, and alloy number 2 typically has a fracture toughness-to-tensile strength value of about 0.17.

The impact toughness-to-maximum load values for alloys according to the present invention can be gauged by reference the ratio of the propagation energy to the maximum load. For alloys according to the present invention the ratio of the propagation energy to the maximum load generally is greater than about 0.0018 ft.lbs/lbs at room temperature, and preferably is at least about 0.002 ft.lbs/lbs. At −40° F., the ratio of the propagation energy to the maximum load generally is greater than about 0.0014 ft.lbs/lbs, and preferably is at least about 0.0016 ft.lbs/lbs.

IV. PRODUCTS MADE FROM THE COMPOSITION

Once the composition has been formed a number of products can be manufactured therefrom, and then processed according to the instructions provided above. The alloys of the present invention likely are best used for low temperature applications, such as at temperatures below about room temperature to as low as about −50° F. The invention is broad enough to cover any such devices made from the composition described herein. One example of a useful device that can be made from such alloys is saw chain. At −20° F. alloy number 7 had a fracture toughness value which was less than half of that for alloy number 2.

Saw chain can be manufactured using conventional techniques that are known to those skilled in the art. Moreover, alloys of the present invention can be used to manufacture saw chain of any design now known or hereafter developed. For instance, the following patents describe particular saw chain designs: (1) U.S. Pat. No. 4,903,562, entitled "Bale Cutting Chain"; (2) U.S. Pat. No. 4,643,065, entitled "Saw Chain Comprised of Safety Side Links Designed for Reducing Vibration"; (3) U.S. Pat. No. 5,123,400, entitled "Saw Chain Having Headless Fastener"; (4) U.S. Pat. No. 4,118,995, entitled "Integral Tie Strap and Rivet Assemblies for Saw Chains"; (5) U.S. Pat. No. 4,353,277, entitled "Saw Chain"; and (6) U.S. Pat. No. 4,535,667, entitled "Saw Chain." Each of these patents is incorporated herein by reference. These patents provide sufficient detail to enable a person skilled in the art to make saw chain. Nevertheless, a brief discussion is provided below solely to render additional guidance concerning how to make saw chain.

FIG. 1 shows one method for assembling saw chain using particular saw chain elements, including tie strap 10, right-hand cutter 12, drive link 14, guard link 16, preset tie strap 18 and left-hand cutter 20. Again, it will be reiterated that the saw chain illustrated in FIG. 1 is just one of many designs for forming useful saw chain. Each of the individual elements, such as the tie strap 10, are formed from the alloys described above using a punch or press die configured in the shape of a particular saw chain element. Each of the parts are formed from the raw composition prior to being heat treated as discussed above. Each of these parts are then sequentially connected to each other in a continuous fashion. Once the saw chain has been assembled so that the tie strap, drive link and preset tie strap are attached to each other, then the hub 22 of the preset tie straps are spun or peened to effectively couple each of the respective elements of the saw chain together. In this fashion, a saw chain can be continuously assembled.

The present invention has been described with reference to preferred embodiments. Other embodiments of the invention will be apparent to those skilled in the art from the consideration of this specification or practice of the invention disclosed herein. It is intended that the specification and any examples be considered as exemplary only, with the true scope and spirit of the invention being indicated by the following claims.

We claim:

1. A steel composition, comprising:

from about 0.25 weight percent to about 0.35 weight percent nickel;

from about 0.2 to about 0.3 weight percent chromium;

from about 0.5 weight percent to less than about 1.0 weight percent carbon;

from about 0.3 to about 0.5 weight percent manganese;

from about 0.1 to about 0.35 weight percent silicon; and from about 0.1 weight percent to about 0.13 weight percent molybdenum and the balance iron and normal small amounts of impurities.

2. The steel composition according to claim 1 comprising about 0.25 weight percent chromium.

3. The steel composition according to claim 1 comprising about 0.25 weight percent nickel and about 0.25 weight percent chromium.

4. The steel composition according to claim 1 having an average fracture toughness after austempering of greater than about 42 ksi $in^{1/2}$.

5. The steel composition according to claim 1 having an average modified Charpy energy-to-failure after austempering of greater than about 2 ft.lbs at temperatures of greater than about −20° F.

6. The steel composition according to claim 1 wherein the ratio of the fracture toughness to the tensile strength after austempering is greater than about 0.15 ksi $in^{1/2}$/ksi.

7. The steel composition according to claim 1 wherein the ratio after austempering of the propagation energy to maximum load at about −40° F. is greater than about 0.0018 ft.lbs/lbs.

8. The steel composition according to claim 1 wherein, after austempering, having an average fracture toughness of greater than about 42 ksi $in^{1/2}$ at room temperature, and an average modified Charpy energy-to-failure after austempering of greater than about 1 ft.lbs at temperatures below about −20° F.

9. The steel composition according to claim 1 having a bainite microstructure.

10. An iron alloy, consisting essentially of:

from about 0.5 to about 1.0 weight percent carbon;

from about 0.25 to about 0.35 weight percent nickel;

from about 0.2 to about 0.3 weight percent chromium;

from about 0.3 to about 0.5 weight percent manganese;

from about 0.1 to about 0.35 weight percent silicon;

from about 0.1 to 0.13 weight percent molybdenum;

from about 0 to about 0.025 weight percent sulfur; and from about 0 to about 0.025 weight percent phosphorous and the balance iron and normal small amounts of impurities.

11. A method for making a steel composition, comprising:

forming an iron alloy that comprises, prior to heat treatment, from about 0.5 to about 1.0 weight percent carbon, from about 0.2 to about 0.4 weight percent nickel, from about 0.2 to about 0.4 weight percent chromium, from about 0.3 to about 0.5 weight percent manganese, from about 0.1 to 0.35 weight percent silicon, and from about 0.08 to 0.20 weight percent molybdenum and the balance iron and normal small amounts of impurities; and heat treating the alloy.

12. The method according to claim 11 wherein the stop of heat treating comprises:

austenitizing the iron alloy to a temperature of greater than about 1550° F. and less than about 1750° F.;

holding the composition at the temperature for at least about five minutes; and substantially immersing the heated alloy into a bath at a temperature of from about 475° F. to about 650° F. for a period of time of at least about ten minutes.

13. The method according to claim 11 wherein following the step of heat treating the alloy the alloy has an average fracture toughness of greater than about 42 ksi $in^{1/2}$.

14. The method according to claim 11 wherein following the step of heat treating the alloy has an average modified Charpy energy-to-failure of greater than about 2 ft.lbs at temperatures greater than about −20° F.

15. The method according to claim 11 wherein following the step of heat treating the ratio of the fracture toughness to the tensile strength is greater than about 0.15 ksi $in^{1/2}$/ksi.

16. The method according to claim 11 wherein following the step of heat treating the ratio of the propagation energy to maximum load at about −40° F. is greater than about 0.0018 ft.lbs/lbs.

17. The method according to claim 11 wherein following the step of heat treating the alloy has an average fracture toughness of greater than about 42 ksi $in^{1/2}$ at room temperature, and an average modified Charpy energy-to-failure at temperatures below about −20° F. of greater than about 1 ft.lbs.

18. A heat treated saw chain link comprising an iron alloy that includes from about 0.5 to about 1.0 weight percent carbon, from about 0.2 to about 0.4 weight percent nickel, from about 0.2 to about 0.4 weight percent chromium, from about 0.3 to about 0.5 weight percent manganese, from about 0.1 to about 0.35 weight percent silicon, and from about 0.08 to 0.20 weight percent molybdenum and the balance iron and normal small amounts of impurities, the link having a bainitic microstructure, the link having been austenitized at a temperature of greater than about 1500° F. and less than about 1750° F. for a period of at least about 5 minutes and austempered at a temperature of from about 475° F. to about 650° F. for a period of time of at least about ten minutes.

19. A method of forming a saw chain, comprising assembling plural saw chain components into a saw chain wherein the plural saw chain components are produced from an iron alloy comprising from about 0.5 to about 1.0 weight percent carbon, from about 0.2 to about 0.4 weight percent nickel, from about 0.2 to about 0.4 weight percent chromium, from about 0.3 to about 0.5 weight percent manganese, from about 0.1 to about 0.35 weight percent silicon, and from about 0.08 to 0.20 weight percent molybdenum and the balance iron and normal small amounts of impurities.

20. A method for forming saw chain, comprising:

forming plural saw chain components from an alloy comprising from about 0.5 to about 1.0 weight percent carbon, from about 0.2 to about 0.4 weight percent nickel, from about 0.2 to about 0.4 weight percent chromium, from about 0.3 to about 0.5 weight percent manganese, from about 0.1 to about 0.35 weigh percent silicon, and from about 0.08 to 0.20 weight percent molybdenum and the balance iron and normal small amounts of impurities;

heat treating the saw chain components; and assembling the components into saw chain.

21. The method according to claim 20 wherein the step of heat treating comprises:

austenitizing the iron alloy to a temperature of greater than about 1500° F. and less than about 1750° F.;

holding the composition at the temperature for at least about five minutes; and immersing the heated alloy into a bath at a temperature of from about 475° F. to about 650° F. for a period of time of at least about ten minutes.

22. A saw chain produced according to the method of claim 19.

23. A saw chain produced according to claim 20.

* * * * *